United States Patent [19]

Alexander

[11] 4,336,738

[45] Jun. 29, 1982

[54] MUSICAL INSTRUMENT

[75] Inventor: Anton Alexander, Mainz, Fed. Rep. of Germany

[73] Assignee: Fa. Gebr. Alexander Rheinische Musikinstrumentenfabrik GmbH, Mainz, Fed. Rep. of Germany

[21] Appl. No.: 158,224

[22] Filed: Jun. 10, 1980

[51] Int. Cl.[3] ..... G10D 9/04

[52] U.S. Cl. ..... 84/390

[58] Field of Search ..... 84/387–390, 84/392

[56] References Cited

U.S. PATENT DOCUMENTS

| | | | |
|---|---|---|---|
| 2,484,408 | 10/1949 | Hubley | 84/390 |
| 4,047,459 | 9/1977 | Nakamura | 84/390 |
| 4,127,050 | 11/1978 | Takeuchi | 84/387 |
| 4,213,371 | 7/1980 | Thayer | 84/390 |

*Primary Examiner*—Lawrence R. Franklin

*Attorney, Agent, or Firm*—Webb, Burden, Robinson & Webb

[57] ABSTRACT

A brass instrument having multiple tuning slide valve blocks is provided with a unique pair of directional air control valves for selecting one tuning slide valve block. The directional air control valves have rotating valve blocks that are disposed on a common axle to be rotated together. A novel lever mechanism biases the axle in a normal position in which the primary tuning slide valve blocks are connected between the mouthpiece and the sound funnel. The lever mechanism permits the rotation of the axle to cause the direction control valves to connect either of the secondary tuning slide valve blocks between the mouthpiece and sound funnel.

3 Claims, 6 Drawing Figures

MUSICAL INSTRUMENT

BACKGROUND

The invention relates to a metallic wind instrument (for example, brass instruments) having two or more tuning slide valve blocks and reversible air control valves (particularly for French horn).

In presently known triple French horns, the three tuning slide valve blocks for the three sides of the horn are engaged and disengaged by a total of four air control valves. The simultaneous actuation of an air control valve pair reroutes the air current to a secondary route and then renewed actuation of another air control valve pair is required to redirect the air current to a secondary route.

It is the aim of the invention to simplify the complicated construction of presently known triple French horns and the like and to noticeably reduce their overall weight.

SUMMARY OF THE INVENTION

The invention solves a problem in a metallic wind instrument (i.e, brass instruments) of the initially mentioned type by using only one directional air control valve pair to selectively direct the air current in each tuning slide valve block, each air control valve consisting of a cylindrical housing having two or more air passages in the casing of the cylinder and one air passage opening to an end face of the cylinder, and also consisting of a rotatable valve body having an internal passage in the form of a pipe elbow.

For practical purposes the two valve bodies of the air control valve pair are disposed on a common rotating axle to rotate together therewith which axle is maintained by spring tension in one control position and is selectively brought into the other control positions by means of a lever mechanism.

Advantageously the lever mechanism comprises a two-armed lever with a shaft that runs at right angles to the arms and is secured to the arms at the pivot point of the lever. The free end of the shaft is held in one control position by means of a spring mechanism secured thereto. The shaft can be swung out in either of two opposite directions by means of finger pressure upon one of the lever arms. The shaft exerts a rotational movement on the rotating axle of the air control valve pair by way of a connecting rod.

The connecting rod can produce the rotational movement of the rotating axle by means of a flexible tension means which is secured to the connecting rod at both ends thereof and wraps around the rotating axle of the air control valve pair.

THE DRAWINGS

An exemplifying embodiment of the invention will now be more fully described with the aid of the drawings.

FIG. 1 schematically shows the basic construction of a triple French horn according to this invention.

DESCRIPTION OF THE PREFERRED EMBODIMENTS

Figure 1:
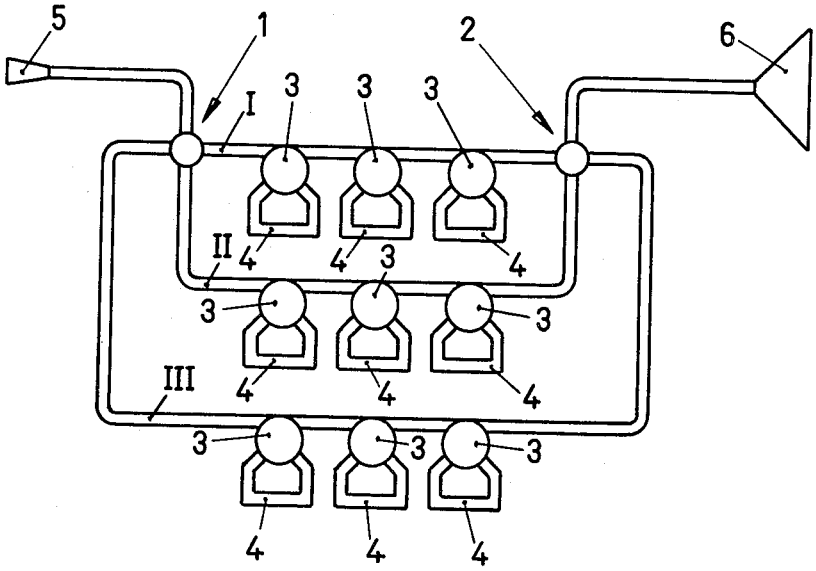

It may be seen from the representation illustrated in FIG. 1 that the air current from the mouthpiece 5 to the sound funnel 6 may be directed, not only by Route I, but also by way of the two secondary Routes, II and III, by the simultaneous actuation of the directional air control valve pairs 1 and 2. The selective direction of the air from the mouthpiece to the sound funnel by way of Route I and the two secondary Routes II and III increases the tonal scope of the French horn to three times that of a simple French horn. The main route and the secondary routes are each equipped with their own similarly constructed tuning slide valve blocks 3, 4.

Figure 2:
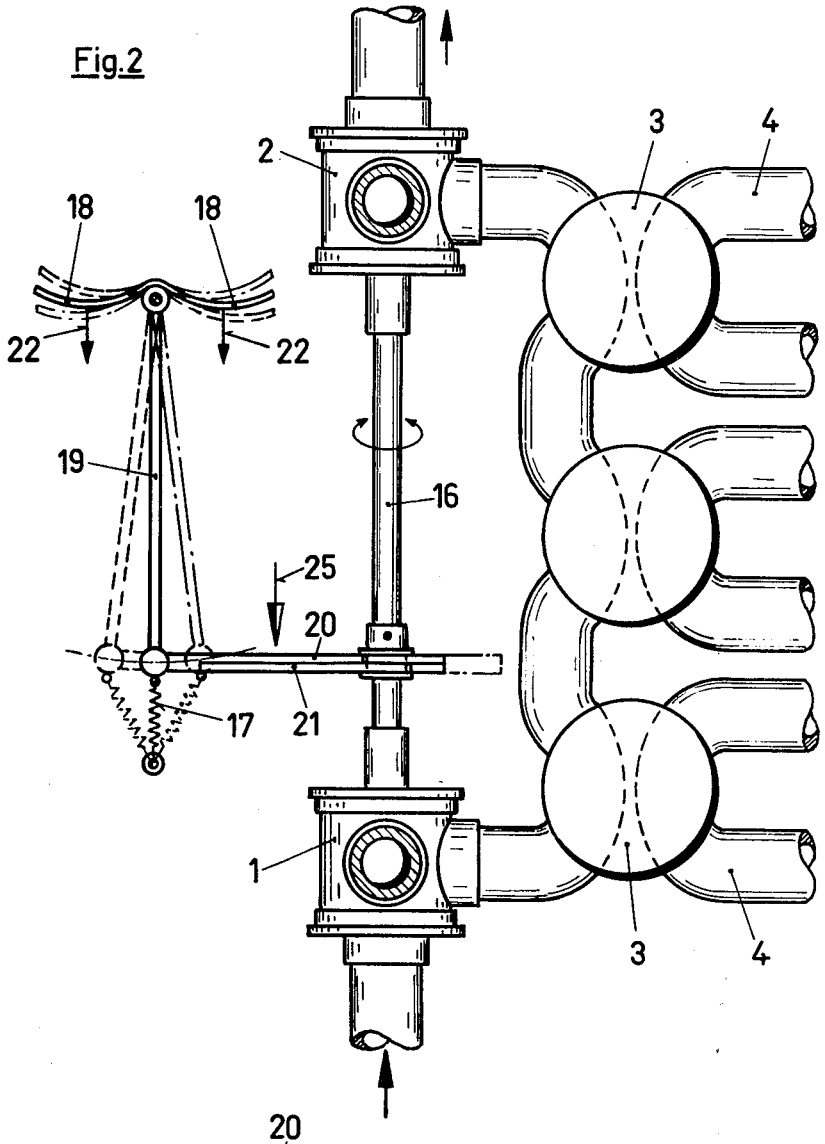
FIG. 2 is a detailed view approximately in natural size of the directional control valves and means for actuating them.
Figure 6:
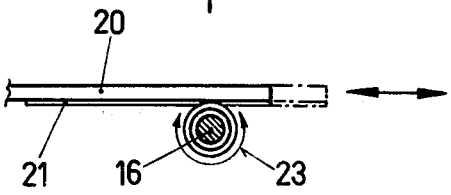
FIG. 6 shows a portion of the lever mechanism viewed in the direction of arrow 25 of FIG. 2.

FIG. 2 discloses further details relative to the common actuation of air control valve pair 1, 2 by means of a novel lever mechanism. The lever mechanism includes the two-armed lever 18 which may be actuated alternatively by means of finger pressure in the direction of arrow 22. At the pivot point the two-arm lever 18 engages a shaft 19 whose free end is maintained by a spring mechanism 17 in a normal position which corresponds to one of the three possible control positions of the valve body 14 in housing 7 of the said air control valves 1 or 2.

A connecting rod 20 is hinged to the free end of shaft 18 and produces a selectable rotational movement 25 of rotating axle 16 with a flexible slide means 21 that wraps around the rotating axle 16 of air control valve pair 1, 2. By way of this connecting rod 20 valve bodies 14 of the two air control valves 1 and 2 are brought into the other two control positions in which the air from the mouthpiece is directed into the two secondary routes.

Figure 3:
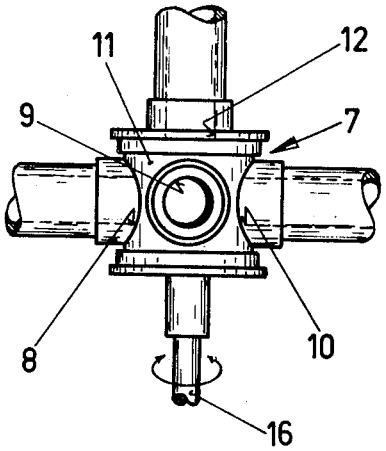
FIG. 3 is a side elevation of the directional air control valve.
Figure 4:
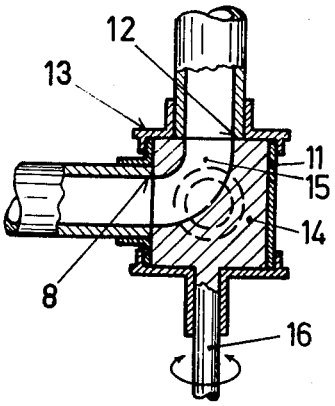
FIG. 4 is a longitudinal section of the subject of FIG. 3.
Figure 5:
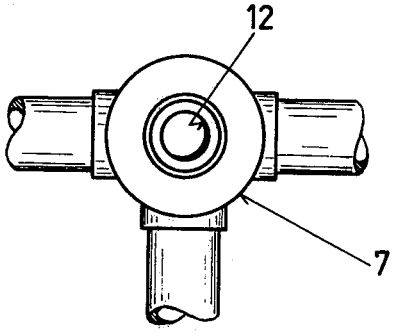
FIG. 5 is a plan view of the subject shown in FIG. 3.

FIGS. 3 to 5 show additional structural characteristic details of preferred three position directional air control valves 1 and 2. What is essential is that the cylindrical casing 11 of each housing 7 exhibits three passages 8, 9, and 10, for air, while the axial end face 13 of the cylinder is provided with the axial air aperture 12. The valve body 14 which has an internal passage in the shape of a pipe elbow is rotatable within the cylindrical casing to selectively bring the port of internal passage which opens on the cylindrical face of the valve body into registry with one of the passages 8, 9, 10 in the cylindrical casing.

Having thus described the invention with the detail and particularity as required by the Patent Office, what is desired protected by Letters Patent is set forth in the following claims.

I claim:

1. A metallic wind instrument with multiple tuning slide valve blocks and a pair of directional air control valves for selecting one tuning slide valve block, there being only one pair of directional air control valves which directs the air current selectively to one tuning slide valve block, each of said directional air control valves consisting of a cylindrical housing having a plurality of apertures for the passage of air therethrough in the cylinder casing thereof and one aperture for the passage of air therethrough in one axial end wall of the cylinder, and a valve body having an internal passage that is in the form of a pipe elbow and is rotatable in the housing to register with one of the plurality of apertures at one time, wherein the two valve bodies of the pair of directional air control valves are disposed on a common rotating axle which is maintained in one control position by spring tension and is selectively brought into the other control positions by means of a lever mechanism.

2. A metallic wind instrument according to claim 1 wherein the lever mechanism comprises a two-armed lever having a shaft that runs at right angles thereto and is engaged at the pivot point of the lever, the free end of the said shaft being held in one control position by means of a spring mechanism hinged on at that point, while by means of finger pressure it may be swung out in two opposite directions to exert a rotary movement on the rotating axle of the directional air control valve pair.

3. A metallic wind instrument according to claim 2, characterized in that the connecting rod produces the rotational movement to the rotating axle by means of a flexible tension medium which is secured to the connecting rod at both ends and wraps around the rotating axle of the air control valve pair.

* * * * *